US010022735B2

(12) United States Patent
Cao et al.

(10) Patent No.: US 10,022,735 B2
(45) Date of Patent: Jul. 17, 2018

(54) MULTISTAGE DECOMPRESSION AND MICRO FLOW ATOMIZING NOZZLE

(71) Applicant: WUXI INSTITUTE OF TECHNOLOGY, Wuxi (CN)

(72) Inventors: Jianfeng Cao, Wuxi (CN); Ping Cui, Wuxi (CN); Huiqin Yan, Wuxi (CN); Huabin Mei, Wuxi (CN)

(73) Assignee: WUXI INSTITUTE OF TECHNOLOGY, Wuxi (CN)

( * ) Notice: Subject to any disclaimer, the term of this patent is extended or adjusted under 35 U.S.C. 154(b) by 25 days.

(21) Appl. No.: 15/260,279

(22) Filed: Sep. 8, 2016

(65) Prior Publication Data

US 2016/0375449 A1 Dec. 29, 2016

Related U.S. Application Data

(63) Continuation-in-part of application No. PCT/CN2015/093706, filed on Nov. 3, 2015.

(30) Foreign Application Priority Data

Apr. 16, 2015 (CN) ..... 2015 1 0180277

(51) Int. Cl.

| | |
|---|---|
| ***B05B 1/00*** | (2006.01) |
| ***B05B 1/30*** | (2006.01) |
| ***B05B 1/34*** | (2006.01) |
| *B05B 1/14* | (2006.01) |

(52) U.S. Cl.

CPC ..... *B05B 1/30* (2013.01); *B05B 1/341* (2013.01); *B05B 1/3405* (2013.01); *B05B 1/3426* (2013.01); *B05B 1/3442* (2013.01); *B05B 1/14* (2013.01)

(58) Field of Classification Search

CPC ..... B05B 1/30; B05B 1/34; B05B 1/3405; B05B 1/341; B05B 1/3426; B05B 1/3442; B05B 1/14

USPC ..... 239/589

See application file for complete search history.

(56) References Cited

U.S. PATENT DOCUMENTS 1,431,526 A * 10/1922 Jacobsen ..... B05B 1/3436 239/490

4,087,050 A * 5/1978 Tsuji ..... F23D 11/383 239/490

* cited by examiner

*Primary Examiner* — Steven J Ganey
*Assistant Examiner* — Viet Le
(74) *Attorney, Agent, or Firm* — Matthias Scholl, PC; Matthias Scholl

(57) ABSTRACT

An atomizing nozzle including a nozzle body, a flow orifice plate, a multi-stage decompression sleeve and a dual-conical surface nozzle head. One end of the nozzle body opposite to the dual-conical surface nozzle head is provided with an external thread; one end of the nozzle body close to the dual-conical surface nozzle head is provided with an internal hole and an internal thread. The external thread of the nozzle body is connected to external equipment. The flow orifice plate, the multi-stage decompression sleeve and the dual-conical surface nozzle head are arranged in the internal hole. The flow orifice plate is arranged on one end of the dual-conical surface nozzle close to the external thread of the nozzle body. The multi-stage decompression sleeve is arranged on the flow orifice plate.

4 Claims, 1 Drawing Sheet

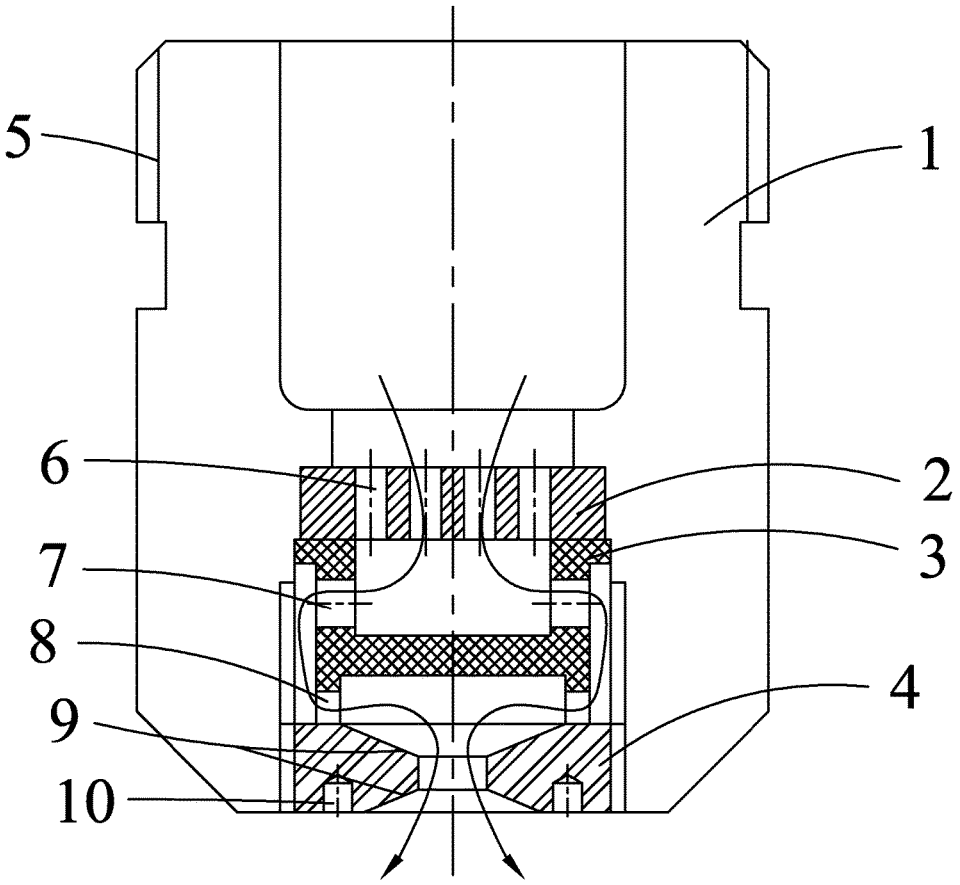
5
1
6
2
7
3
8
4
9
10

MULTISTAGE DECOMPRESSION AND MICRO FLOW ATOMIZING NOZZLE

CROSS-REFERENCE TO RELATED APPLICATIONS

This application is a continuation-in-part of International Patent Application No. PCT/CN2015/093706 with an international filing date of Nov. 3, 2015, designating the United States, now pending, and further claims priority benefits to Chinese Patent Application No. 201510180277.1 filed Apr. 16, 2015. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

Field of the Invention

The invention relates to a multistage decompression and micro flow atomizing nozzle which converts a high-pressure medium into a low-pressure micro atomized medium to mix with another medium evenly.

Description of the Related Art

In heavy industries like petroleum, chemical and steel and iron industries, there are many situations of converting high-pressure media into low-pressure media to allow multiple media and auxiliary materials to mix accurately under low-pressure working conditions, and high-pressure equipment is costly and has a very short service life. Ordinary nozzles are scoured seriously under high-pressure conditions and have no flow control parts so a separate control unit is needed.

SUMMARY OF THE INVENTION

In view of the above described problems, the invention provides a multistage decompression and micro flow atomizing nozzle to solve the shortcomings. After entering the nozzle, the high-pressure medium firstly passes through the flow control part on the rear end of the nozzle to obtain the accurate flow rate. After multi-corner decompression, the high-pressure medium passes through a rotating flow channel with an angle of 20 degrees. Meanwhile, since the high-pressure medium undergoes multi-stage decompression, the low-pressure medium is outputted, reduces scouring friction against the nozzle, greatly improves the service life of the nozzle and guarantees the atomization effect at the outlet to the greatest extent by adopting a rotating flow channel with an angle of 20 degrees. The invention provides a multi-functional nozzle which integrates flow control, multi-stage decompression and atomized media.

A multistage decompression and micro flow atomizing nozzle is realized by the following technical proposals:

A multistage decompression and micro flow atomizing nozzle comprises a nozzle body, a flow orifice plate, a multi-stage decompression sleeve and a dual-conical surface nozzle head. One end of the nozzle body opposite to the dual-conical surface nozzle head is provided with an external thread; one end of the nozzle body close to the dual-conical surface nozzle head is provided with an internal hole and an internal thread; the external thread of the nozzle body is connected to external equipment; the flow orifice plate, the multi-stage decompression sleeve and the dual-conical surface nozzle head are arranged in the internal hole; the flow orifice plate is arranged on one end of the dual-conical surface nozzle close to the external thread of the nozzle body; the multi-stage decompression sleeve is arranged on the flow orifice plate; a first second flow hole and a rotating flow channel having an angle of 20 degrees are arranged on the multi-stage decompression sleeve, where the angle of 20 degrees refers to an included angle between an axis of the flow channel and a vertical axis; and the dual-conical surface nozzle head comprises an external thread which matches the internal thread of the nozzle body; fixing holes are arranged on the dual-conical surface nozzle head to fix parts on the dual-conical surface nozzle head.

The rear end of the nozzle body is the thread or other connecting modes.

A second flow hole is arranged on the flow orifice plate; at least three second flow holes are arranged on the flow orifice plate; the number of the flow orifice plate is determined by specific flow rate, and the second flow hole is a round hole, a square hole or holes of other shapes.

One end of the multi-stage decompression sleeve is a square flow channel or a round flow channel or flow channels of other shapes. The flow area is the same as the flow area of the flow orifice plate.

The other end of the multi-stage decompression sleeve is the rotating flow channel with an angle of 20 degrees. The angle of 20 degrees refers to the included angle between the axis of the flow channel and the vertical axis. The angle area is the same as the flow area of the flow orifice plate. The number of flow channels may be one channel or multiple channels.

There is clearance between the external surface of the multi-stage decompression sleeve and the nozzle body and the internal holes. The total area of the clearance is the same as the flow area of the flow orifice plate.

The included angle between the conical surface of the two ends of the dual-conical surface nozzle head is 140°. The flow area of the center hole is the same as the flow area of the flow orifice plate.

Fixing holes are arranged on one end face of the dual-conical surface nozzle head for tightening threads. The number of the fixing holes is two or more.

The fixing method of the nozzle adopts thread connection or welding connection or other connection methods.

Operating principle: When a multistage decompression and micro flow atomizing nozzle operates, after entering the nozzle, the high-pressure medium firstly passes through the flow control part on the rear end of the nozzle. After multi-corner decompression of the multi-stage decompression sleeve, the high-pressure medium passes through a rotating flow channel with an angle of 20 degrees to obtain an accurate flow rate. Meanwhile, since the high- pressure medium undergoes multi-stage decompression, the low-pressure medium is outputted. A flow orifice plate is arranged in the nozzle and can be replaced according to the actual flow rate. After the medium undergoes the multi-stage decompression and the rotation in the rotating flow channel with an angle of 20 degrees, the low-pressure atomized medium flows out of the nozzle head.

The atomizing nozzle of embodiments of the invention has the advantages as follows: the atomizing nozzle controls the flow rate of the medium by flow orifice plate and the flow area of the flow orifice plate can be processed according to actual needs. The multi-corner design of the multi-stage decompression sleeve guarantees high-pressure input and low-pressure output and extends the service life of the nozzle to the greatest extent. The rotating flow channel with an angle of 20 degrees and the dual-conical surface nozzle head with an angle of 140 degrees enable the medium keeps in a rotating atomized state when being sprayed out so the medium and the main material can mix better.

The atomizing nozzle adopts integrated flow control parts and multi-stage decompression and can improve the service life greatly. Meanwhile, the rotating flow channel with an angle of 20 degrees enhances the atomized effect of the medium at the outlet to make the medium and high-temperature low-pressure steam mix evenly to save materials.

The invention relates to an integrated nozzle head which has the functions of flow control, multi-stage decompression and medium atomization. The invention adopts replaceable and modular design and doesn't need additional decompression or flow control parts. As the market has higher requirements on the controllability and integration level of products, the invention can fully meet broader market requirements. In practical application, the invention can be used for working occasions such as turbine systems, boiler systems, and the blending of high-pressure and low-pressure media. As the requirement of energy utilization efficiency has been improved, the invention has a broad prospect.

BRIEF DESCRIPTION OF THE DRAWINGS

The invention is described hereinbelow with reference to accompanying drawings, in which the sole FIGURE is a multistage decompression and micro flow atomizing nozzle of the invention.

In the drawings, the following reference numbers are used: 1. nozzle body; 2. flow orifice plate; 3. multi-stage decompression sleeve; 4. dual-conical surface nozzle head; 5. thread of the nozzle body; 6. second flow hole; 7. first flow hole; 8. rotating flow channel with an angle of 20 degrees; 9. dual-conical surface with an angle of 140 degrees; and 10. fixing hole.

DETAILED DESCRIPTION OF THE EMBODIMENTS

For further illustrating the invention, experiments detailing a multistage decompression and micro flow atomizing nozzle are described below. It should be noted that the following examples are intended to describe and not to limit the invention.

As shown in the sole FIGURE, a multistage decompression and micro flow atomizing nozzle comprises a nozzle body 1, a flow orifice plate 2, a multi-stage decompression sleeve 3, and a dual-conical surface nozzle head 4. An external thread 5 is arranged on the rear end of the nozzle body 1. An internal hole and an internal thread are arranged on the top of the nozzle body 1. The external thread 5 on the rear end of the nozzle body 1 is connected to external equipment. The flow orifice plate 2, the multi-stage decompression sleeve 3 and the dual-conical surface nozzle head 4 are arranged in the internal hole. The flow orifice plate 2 is arranged on the one end of the dual-conical surface nozzle close to the external thread of the nozzle body 5. The multi-stage decompression sleeve 3 is arranged on the flow orifice plate 2. The first flow hole 7 and the rotating flow channel 8 with an angle of 20 degrees are arranged on the multi-stage decompression sleeve 3. The rotating angle of 20 degrees refers to the included angle between the axis of the flow channel and the vertical axis. The external thread of the dual-conical surface nozzle head 4 matches the internal thread on the top of the nozzle body. Fixing holes are arranged on the dual-conical surface nozzle head 4. Other parts are fixed by the thread of the fixing hole on the dual-conical surface nozzle head 4.

The second flow hole 6 for flow control is arranged on the flow orifice plate 2. The first flow hole 7 is arranged on one end of the multi-stage decompression sleeve 3. The other end is the rotating flow channel 8 with an angle of 20 degrees. Both ends of the dual-conical surface nozzle head 4 are the dual-conical surface 9 with an angle of 140 degrees. The central part of the dual-conical surface nozzle head has flow holes. One section of the central part has fixing holes 10.

The second flow hole 6 is arranged on the flow orifice plate 2. At least 3 flow holes A 6 are arranged on the flow orifice plate 2. The number of the flow holes is determined by the specific flow rate. The second flow hole 6 may be a round hole, a square hole or holes of other shapes.

The second flow hole 6 is arranged on the flow orifice plate 2 for flow control. The number and shape of the flow holes can be arranged according to the actual flow rate.

One end of the multi-stage decompression sleeve 3 is a square flow channel or a round flow channel or flow channels of other shapes. The flow area is the same as the flow area of the flow orifice plate. The other end of the multi-stage decompression sleeve is the rotating flow channel 8. The included angle between the horizontal axis and the vertical axis which is 20 degrees can also be adjusted according to actual situations.

One end of the multi-stage decompression sleeve 3 is the rotating flow channel 8 with an angle of 20 degrees. The included angle between the horizontal axis and the vertical axis which is 20 degrees can also be adjusted according to the rotating and atomizing conditions in practical application.

The flow area of the second flow hole 6, the flow area of the first flow hole 7, the flow area of the rotating flow channel 8 with an angle of 20 degrees, and the flow area of the dual-conical surface nozzle head 4 are the same.

The dual-conical surface nozzle head 4 and the nozzle body 1 are connected by thread and tightened by the fixing hole 10, or connected by welding or other connection methods.

The nozzle body 1, the flow orifice plate 2, the multi-stage decompression sleeve 3, and the dual-conical surface nozzle head 4 are machined by using forging pieces and bar materials. Corresponding materials are chosen according to actual conditions and are not limited to specific materials.

EXAMPLE

When a multistage decompression and micro flow atomizing nozzle operates, the nozzle body 1 is connected with external equipment, and the high-pressure medium firstly enters the flow orifice plate 2 and passes through a certain amount of flow holes A 6 of certain shapes to obtain the controlled flow rate.

The high-pressure medium passes through the first flow hole 7 on one end of the multi-stage decompression sleeve 3 to realize the first-stage corner decompression and then passes through the rotating flow channel 8 with an angle of 20 degrees to realize multi-stage decompression. The included angle between the horizontal axis and the vertical axis is 20 degrees to realize the best rotating angle.

The dual-conical surface 9 with an angle of 140 degrees on both ends of the dual-conical surface nozzle head 4 is convenient for the dispersion of the rotating medium to realize the best atomization effect. The external thread of the dual-conical surface nozzle head 4 matches the internal thread of the nozzle body 1. The dual-conical surface nozzle head 4 is tightened by fixing hole 10.

The embodiment presents a multistage decompression and micro flow atomizing nozzle, in particular to an integrated nozzle which has the functions of flow control, multi-stage decompression and medium atomization. The invention presents a similar device produced by using the invention to realize the aim and characteristics of the invention. A multistage decompression and micro flow atomizing nozzle of the invention aims at saving costs and solving the problem that the nozzle head is easy to be scoured under high-pressure working conditions.

The invention claimed is:

1. An atomizing nozzle, comprising:

a) a nozzle body;

b) a flow orifice plate;

c) a multi-stage decompression sleeve; and d) a dual-conical surface nozzle head;

wherein one end of the nozzle body opposite to the dual-conical surface nozzle head is provided with an external thread; one end of the nozzle body close to the dual-conical surface nozzle head is provided with an internal hole and an internal thread; the external thread of the nozzle body is configured to be connected to external equipment;

the flow orifice plate, the multi-stage decompression sleeve and the dual-conical surface nozzle head are arranged in the internal hole;

a plurality of flow holes is arranged on the flow orifice plate;

the flow orifice plate is connected to the multi-stage decompression sleeve; a rotating flow channel having an angle of 20 degrees is arranged on the multi-stage decompression sleeve, wherein the angle of 20 degrees refers to an included angle between an axis of the rotating flow channel and a vertical axis;

the rotating flow channel has an entrance opening arranged on an inner wall of the multi-stage decompression sleeve;

the plurality of flow holes combined have a first cross-sectional area;

the entrance opening has a second cross-sectional area;

the first cross-sectional area is equal to the second cross-sectional area; and the dual-conical surface nozzle head comprises an external thread which matches the internal thread of the nozzle body; fixing holes are arranged on the dual-conical surface nozzle head to fix parts on the dual-conical surface nozzle head.

2. The atomizing nozzle of claim 1, wherein each of the plurality of flow holes is a round hole, a square hole or holes of other shapes.

3. The atomizing nozzle of claim 1, wherein both ends of the dual-conical surface nozzle head are dual conical surfaces with a conical angle of 140 degrees.

4. The atomizing nozzle of claim 1, wherein the dual-conical surface nozzle head and the nozzle body are connected by thread and tightened by the fixing holes, or connected by welding.

* * * * *